US008968121B2

(12) United States Patent
Leggett et al.

(10) Patent No.: US 8,968,121 B2
(45) Date of Patent: Mar. 3, 2015

(54) CUFF-BASED ATHLETIC TRAINING DEVICE

(71) Applicant: LDM Partnership, LLC, Douglasville, GA (US)

(72) Inventors: Brian Leggett, Douglasville, GA (US); Delino DeShields, Atlanta, GA (US); Lincoln Martin, Douglasville, GA (US)

(73) Assignee: LDM Partnership, LLC, Douglasville, GA (US)

( * ) Notice: Subject to any disclaimer, the term of this patent is extended or adjusted under 35 U.S.C. 154(b) by 0 days.

(21) Appl. No.: 14/010,807

(22) Filed: Aug. 27, 2013

(65) Prior Publication Data

US 2014/0057743 A1 Feb. 27, 2014

Related U.S. Application Data

(60) Provisional application No. 61/693,632, filed on Aug. 27, 2012.

(51) Int. Cl.

| | |
|---|---|
| ***A63B 69/00*** | (2006.01) |
| *A63B 69/36* | (2006.01) |
| *A63B 69/38* | (2006.01) |

(52) U.S. Cl.

CPC ..... *A63B 69/0002* (2013.01); *A63B 69/0059* (2013.01); *A63B 69/0015* (2013.01); *A63B 69/3623* (2013.01); *A63B 69/3676* (2013.01); *A63B 69/38* (2013.01); *A63B 2069/0008* (2013.01); *A63B 2209/10* (2013.01)

USPC ..... 473/458; 473/422; 473/451

(58) Field of Classification Search

USPC ..... 473/422, 450, 453, 458, 464, 438, 451, 473/212–215; D21/781, 692; 70/16; 128/878; 602/64; 119/856; D2/625; 482/124, 126

See application file for complete search history.

(56) References Cited

U.S. PATENT DOCUMENTS

| | | | | | |
|---|---|---|---|---|---|
| 4,815,731 | A | * | 3/1989 | Suarez et al. | 482/124 |
| 5,111,771 | A | * | 5/1992 | Mathews | 473/575 |
| 5,284,459 | A | * | 2/1994 | Podd, III | 482/51 |
| D353,172 | S | * | 12/1994 | Gaut | D21/692 |
| D396,077 | S | * | 7/1998 | Heine | D21/662 |
| 5,839,978 | A | * | 11/1998 | Evangelist | 473/458 |
| 5,938,548 | A | | 8/1999 | Upshaw | |
| 5,996,380 | A | * | 12/1999 | Harris | 473/212 |
| 6,519,778 | B2 | * | 2/2003 | Arias et al. | 2/207 |

(Continued)

*Primary Examiner* — Mitra Aryanpour

(74) *Attorney, Agent, or Firm* — Morris, Manning & Martin, LLP; Daniel E. Sineway, Esq.

(57) ABSTRACT

An athletic training device for enabling and teaching proper athletic movements while executing various athletic exercises. Particularly, the present disclosure relates to an athletic training device that enhances neuromuscular control in connection with keeping an athlete's hands close to each other, and also close to his/her torso by providing a restricted range of motion while being easily wearable and removable. Generally, embodiments of the present disclosure relate to adjustable, comfortable, cuff-based training devices that securely encircle a user's wrists with cuff-based members flexibly bound together for use in connection with swing-based movements. A central connecting sub-section typically comprises attachments, which affix a resilient, flexible medium to either of the cuff-based members providing a limited-but not unduly rigid-range of motion during utilization. Moreover, the cuff-based training device provides rigidity while contorting as the wearer performs various athletic actions confirming correct and proper techniques.

5 Claims, 8 Drawing Sheets

(56) References Cited

U.S. PATENT DOCUMENTS

| | | | | |
|---|---|---|---|---|
| 6,537,160 | B2 | 3/2003 | Chrystal | |
| 6,984,184 | B2 * | 1/2006 | Gray | 473/458 |
| 7,179,211 | B2 * | 2/2007 | Broadwater | 482/126 |
| 7,214,171 | B2 * | 5/2007 | Thelen et al. | 482/124 |
| 7,581,762 | B1 * | 9/2009 | Werner | 285/254 |
| 2005/0084359 | A1 * | 4/2005 | Dempsey et al. | 410/118 |
| 2008/0214330 | A1 * | 9/2008 | Goebel | 473/438 |
| 2010/0246331 | A1 * | 9/2010 | Paul et al. | 367/173 |

* cited by examiner

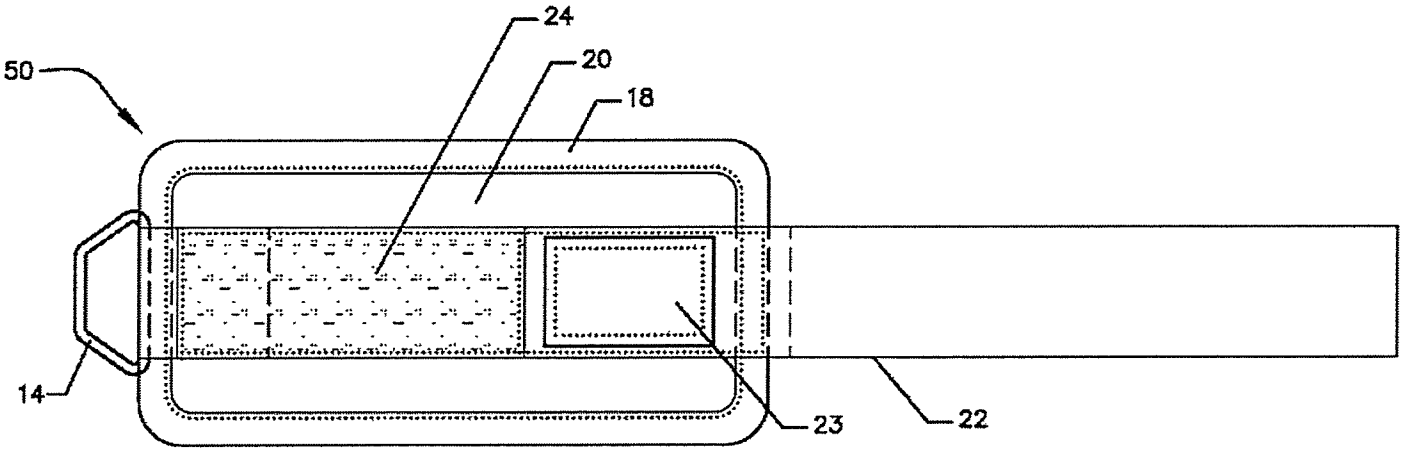
FIGURE 5.A
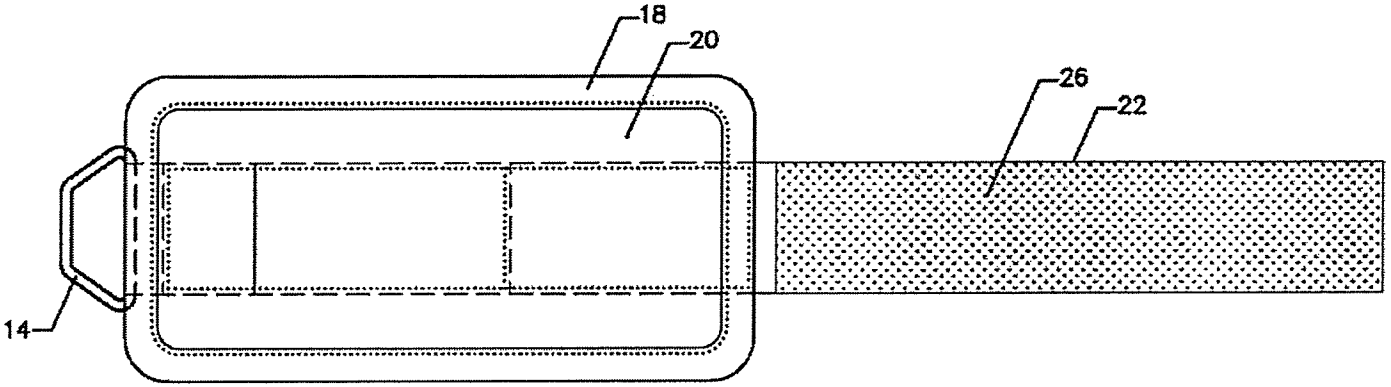
FIGURE 5.B

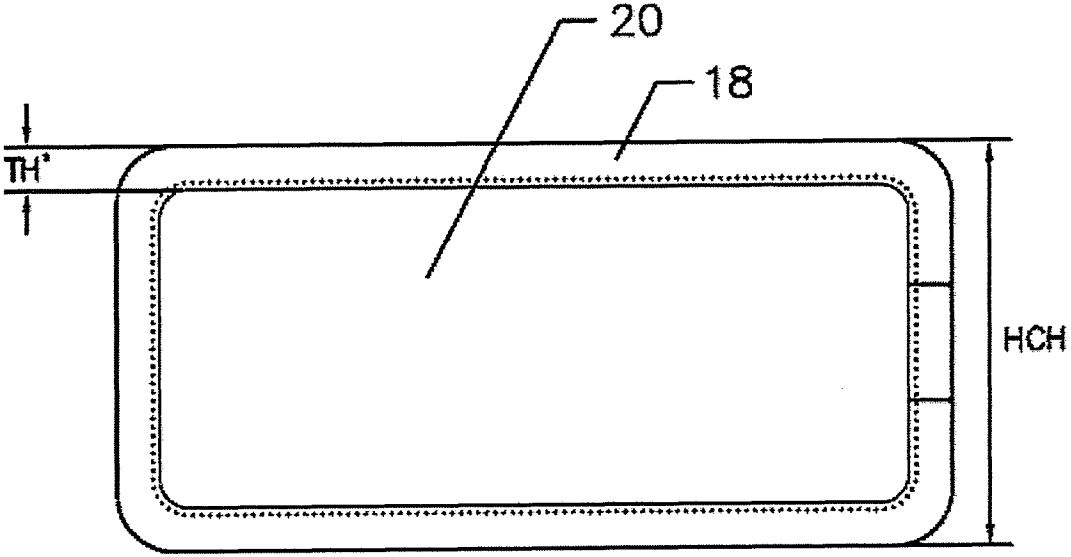
FIGURE 6.A
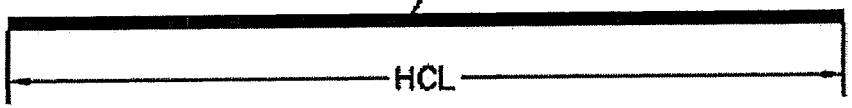
FIGURE 6.B

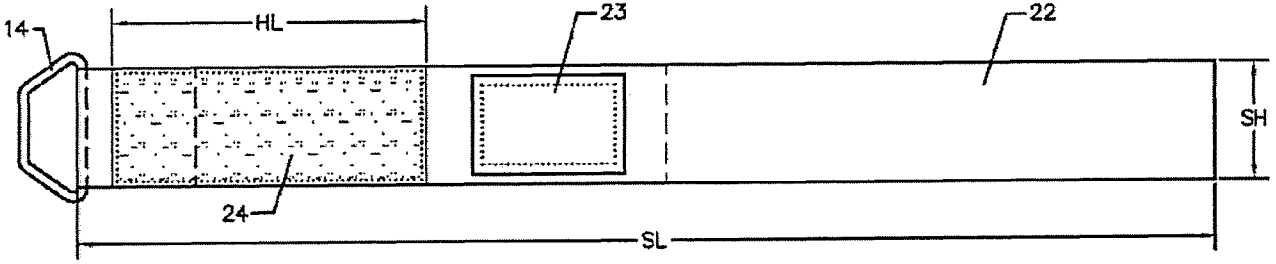
FIGURE 7.A
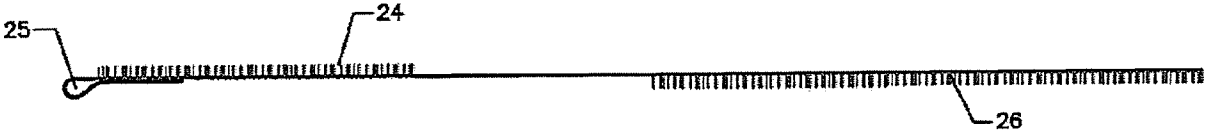
FIGURE 7.B
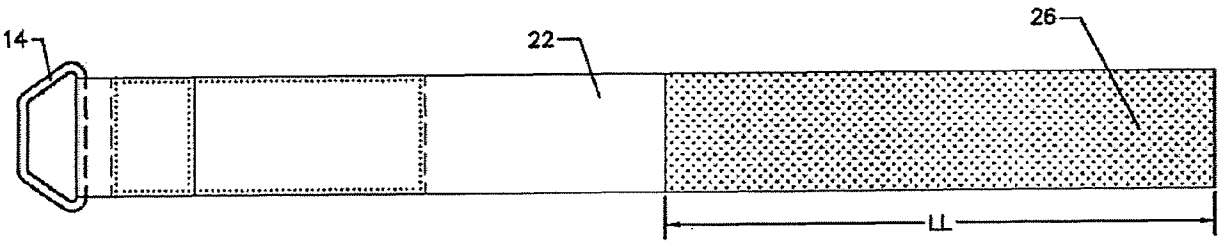
FIGURE 7.C
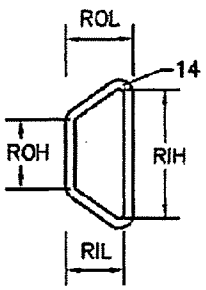
FIGURE 7.D

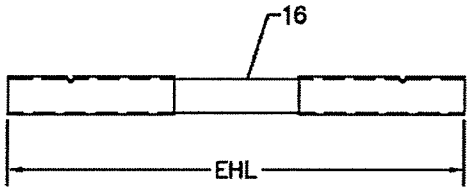
FIGURE 8.A
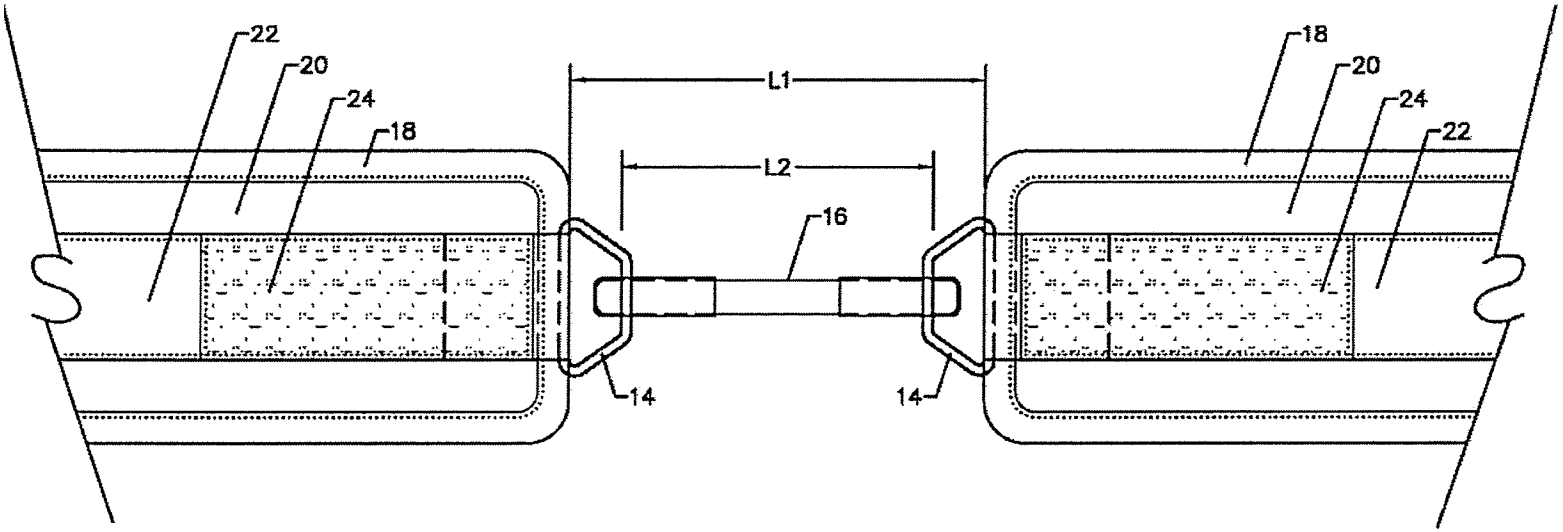
FIGURE 8.B

CUFF-BASED ATHLETIC TRAINING DEVICE

CROSS REFERENCE TO RELATED APPLICATION

This application claims benefit under 35 U.S.C. §119(e) of U.S. Provisional Patent Application No. 61/693,632, filed Aug. 27, 2012, and entitled "Cuff-Based Athletic Training Device," which is incorporated herein by reference as if set forth herein in its entirety.

TECHNICAL FIELD

The present disclosure relates generally to athletic training devices, and more particularly to cuff-based athletic training devices for improving athletic abilities of persons involved in swing-based sports such as baseball, cricket, golf, softball, tennis, and the like.

BACKGROUND

In many kinds of swing-based sports, it is desirous for an athlete to keep his or her hands in close proximity to each other (e.g., as needed during a swing or when fielding a ball) to promote enhanced control and a good finishing position during various athletic moves. Also, in some circumstances it is advantageous for an athlete to keep his or her hands in close proximity to his or her torso prior to extending them outwardly. The correct execution of these movements during swing-based sports generally promotes desired athletic performance. Examples of such sports include (but are not limited to) baseball, cricket, softball, and golf, wherein an athlete preferably keeps the hands close to each other and close to the torso (e.g., before swinging a baseball bat, cricket bat, or a golf club). In another instance, instead of trying to reach for an incoming ball while extending the arms in a "fielding position" (e.g., in a sport like baseball or cricket) an athlete can obtain a positional advantage if he or she moves his or her feet longitudinally or latitudinally in unison with the rest of his or her body.

Traditionally, persons playing sports to improve their athletic abilities use athletic training devices. Such devices generally help develop agility and/or muscle memory for improving sports and athletic performance. Use of said devices can assist in swing position, torso position, body movement, or muscle memory. Athletic training aids or devices are available for various sports, but are often implemented on a misguided portion of the user's body creating discomfort and improper movement. Some of these devices can have multiple uses; therefore, they may be utilized for improving performance for a plurality of sports. Further, these training devices promote proper athletic mechanics when enacting routine movements. Repetitively performing athletic drills with training aids can help an athlete's muscles "remember" proper techniques.

However, many of these athletic training devices are often restrictive to the athlete. For example, some devices do not allow for full range of motion of the wearer's hands as needed in a swing or in other positions, which can cause injury to the wearer. Specifically, many devices do not have the resiliency, comfort, or performance desired by a wearer. Further, uncomfortable training aids can hinder the proper form the device aims to instill. Often, one's desire to relieve discomfort during athletic drills produces a breakdown of appropriate movement thereby invalidating the device's function. Another particular disadvantage of many traditional training devices comprises the many associated moving or complex parts or components of the device, such that a user has difficulty carrying and/or utilizing the device. Training aids are tools designed to encourage athletes to progress in skill and craft. Nuisance devices that provide challenges for athletes generally stemming from device intricacy, awkwardness, or convolution can detract from device utilization and the end goal of athletic improvement.

Some types of conventional training devices fit loosely around the portion of the body to which they are designated to adhere. A loose fit makes it difficult to ensure that the athlete, while repetitively training, is consecutively executing the correct motions. Generally, a training aid attached securely and comfortably to the user will confirm repetitive motions are exercised in like manner consecutively. Because not every user's or athlete's body is exactly the same, an athletic training device should be rigid, ensuring exercises and athletic actions are executed properly, but not so rigid that it does not conform to the athlete's specific body profile.

Therefore, there is a long-felt but unresolved need for an athletic training device for swing based-sports that enables athletes to gain muscle memory in connection with keeping his or her hands in close proximity to each other, and to the athlete torsos. There is a further need for a device that provides some degree of freedom of movement and yet provides the required restricted range of motion for effective training. The device should be lightweight, portable, and easy to use. Furthermore, the device should be comfortable and not have toxic effects on an athlete's body when worn for long periods of time.

BRIEF SUMMARY OF THE DISCLOSURE

Briefly described and according to one embodiment, aspects of the present disclosure generally relate to athletic training devices for enabling and teaching proper athletic movements while executing various athletic exercises. Particularly, embodiments of the present disclosure relate to athletic training devices that enhance neuromuscular control in connection with keeping an athlete's hands close to each other, and also close to his/her torso by providing a restricted range of motion while being easily wearable and removable. Generally, embodiments of the present disclosure relate to adjustable, comfortable, cuff-based training devices that securely encircle a user's wrists with cuff-based members flexibly bound together. Moreover, the cuff-based training device provides rigidity while contorting as the wearer performs various athletic actions confirming correct and proper techniques.

According to one embodiment, the athletic training device comprises adjustable, durable straps with attached cuffs (e.g., semi-rigid foam pads), forming cuff-based members. The cuff-based members are fashioned from comfortable materials that encircle the wrists of an athlete when in use. Further, the cuff-based members generally contain a fastening means enabling the cuffs to remain secure around the wrists of an athlete during various athletic activities. According to one embodiment, the cuff-based athletic training device comprises central connecting sub-section joining the cuff-based members. The central connecting sub-section typically comprises attachments that affix a resilient, flexible medium to either of the cuff-based members providing a limited-but not unduly rigid-range of motion during utilization. Other details, aspects, and features of embodiments of the present athletic training device are described in greater detail herein.

These and other aspects, features, and benefits of the claimed invention(s) will become apparent from the following detailed written description of the preferred embodiments and aspects taken in conjunction with the following drawings, although variations and modifications thereto may be effected without departing from the spirit and scope of the novel concepts of the disclosure.

BRIEF DESCRIPTION OF THE DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein:

FIG. 5A illustrates a plan view of one embodiment of the device extended and laying flat.

FIG. 5B is another plan view of an interior surface of an embodiment of the disclosed device extended and laying flat.

FIG. 6A illustrates a detail view of an embodiment of a cuff portion of the disclosed device.

FIG. 6B illustrates a side view of the exterior surface of a cuff portion shown in FIG. 6A.

FIG. 7A illustrates a plan view of an embodiment comprising the exterior of the strap portion extended flat.

FIG. 7B is side view of the strap portion illustrated in FIG. 7A.

FIG. 7C is a plan view of the interior surface of one embodiment of the strap portion as shown in FIGS. 7A and 7B.

FIG. 7D is a detail view of one embodiment of the ring element in the disclosed device.

FIG. 8A illustrates a detail view of one exemplary embodiment of the connecting element in the present device.

FIG. 8B shows a plan detail view of one embodiment of the disclosed device extended flat.

DETAILED DESCRIPTION

Figure 1:
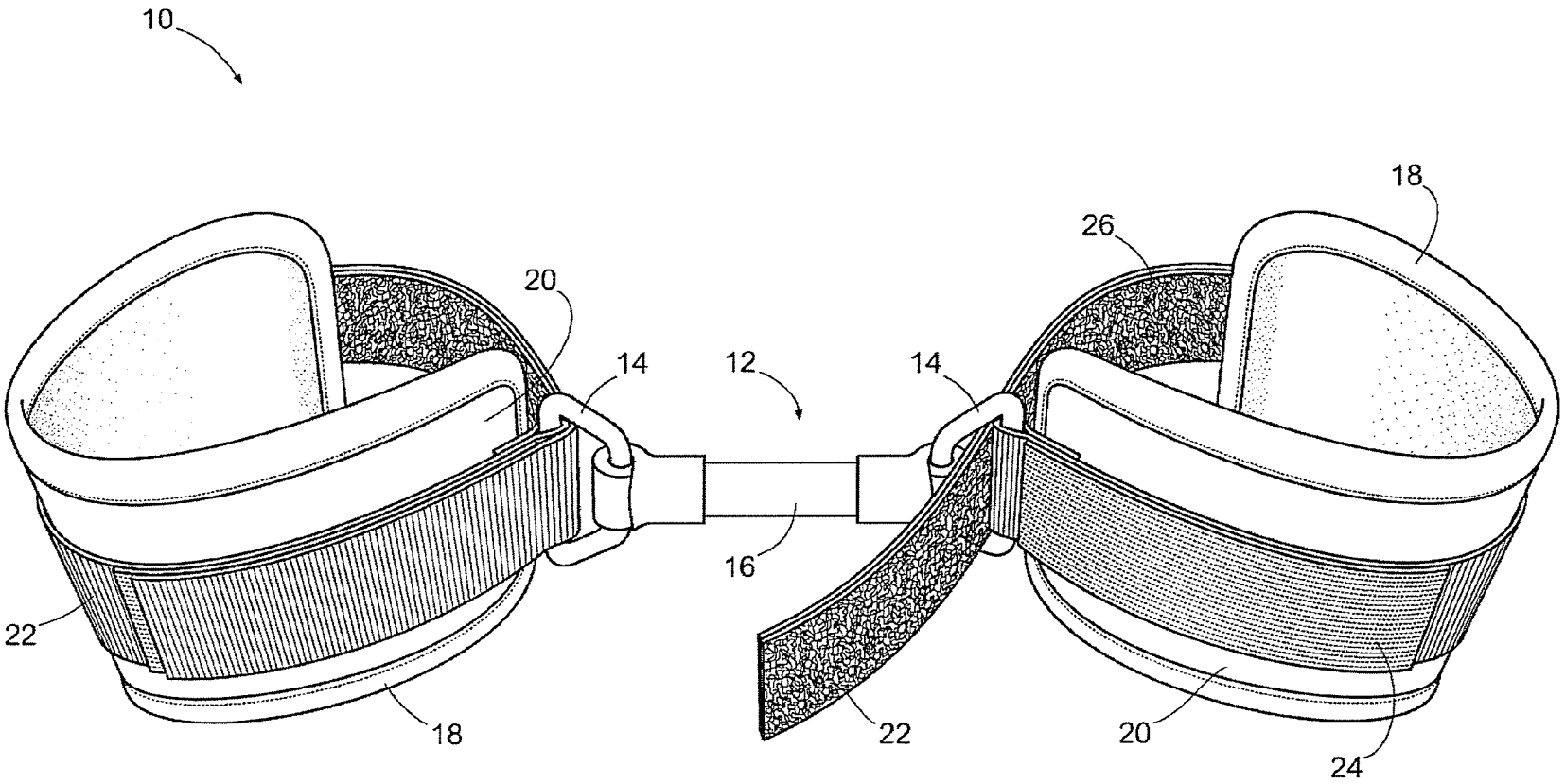
FIG. 1 illustrates a perspective view of an embodiment of the present device.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments and any further applications of the principles of the disclosure as illustrated therein are contemplated as would normally occur to one skilled in the art to which the disclosure relates. All limitations of scope should be determined in accordance with and as expressed in the claims.

OVERVIEW

Aspects of the present disclosure generally relate to athletic training devices for enabling and teaching proper athletic movements while executing various athletic exercises. Particularly, embodiments of the present disclosure relate to athletic training devices that enhance neuromuscular control in connection with keeping an athlete's hands close to each other, and also close to his/her torso by providing a restricted range of motion while being easily wearable and removable. Generally, embodiments of the present disclosure relate to adjustable, comfortable, cuff-based training devices that securely encircle a user's wrists with cuff-based members flexibly bound together. Moreover, the cuff-based training device provides rigidity while contorting as the wearer performs various athletic actions confirming correct and proper techniques.

According to one embodiment, the athletic training device comprises adjustable, durable straps with attached cuffs (e.g., semi-rigid foam pads), forming cuff-based members. The cuff-based members are fashioned from comfortable materials, which encircle the wrists of an athlete when in use. Further, the cuff-based members generally contain a fastening means enabling the cuffs to remain secure around the wrists of an athlete during various athletic activities. According to one embodiment, the cuff-based athletic training device comprises central connecting sub-section joining the cuff-based members. The central connecting sub-section typically comprises attachments that affix a resilient, flexible medium to either of the cuff-based members providing a limited- but not unduly rigid-range of motion during utilization. Other details, aspects, and features of embodiments of the present athletic training device are described in greater detail herein.

Exemplary Embodiment

Figure 2:
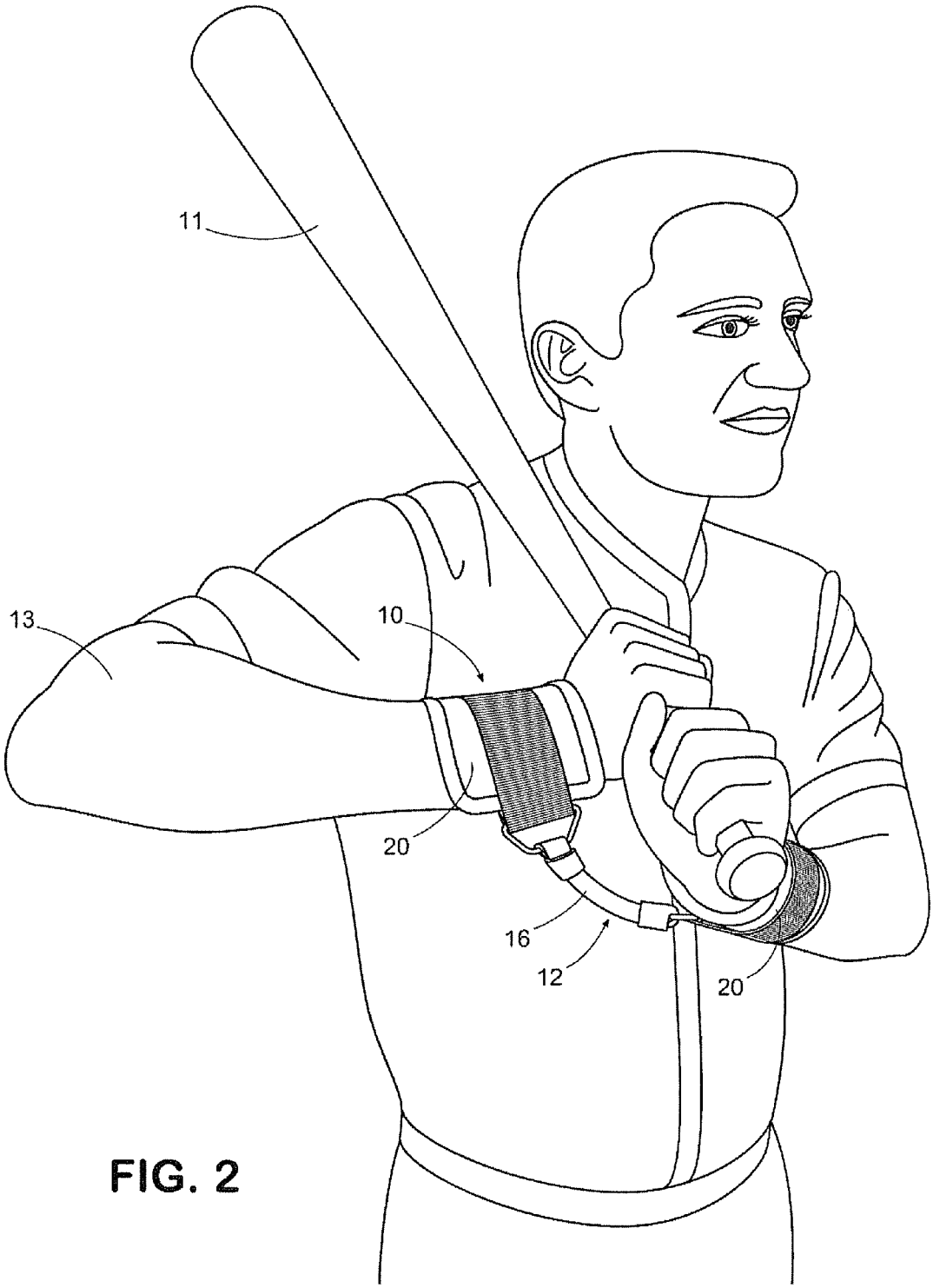
FIG. 2 illustrates a perspective view of one embodiment of the device in use by an athlete.
Figure 3:
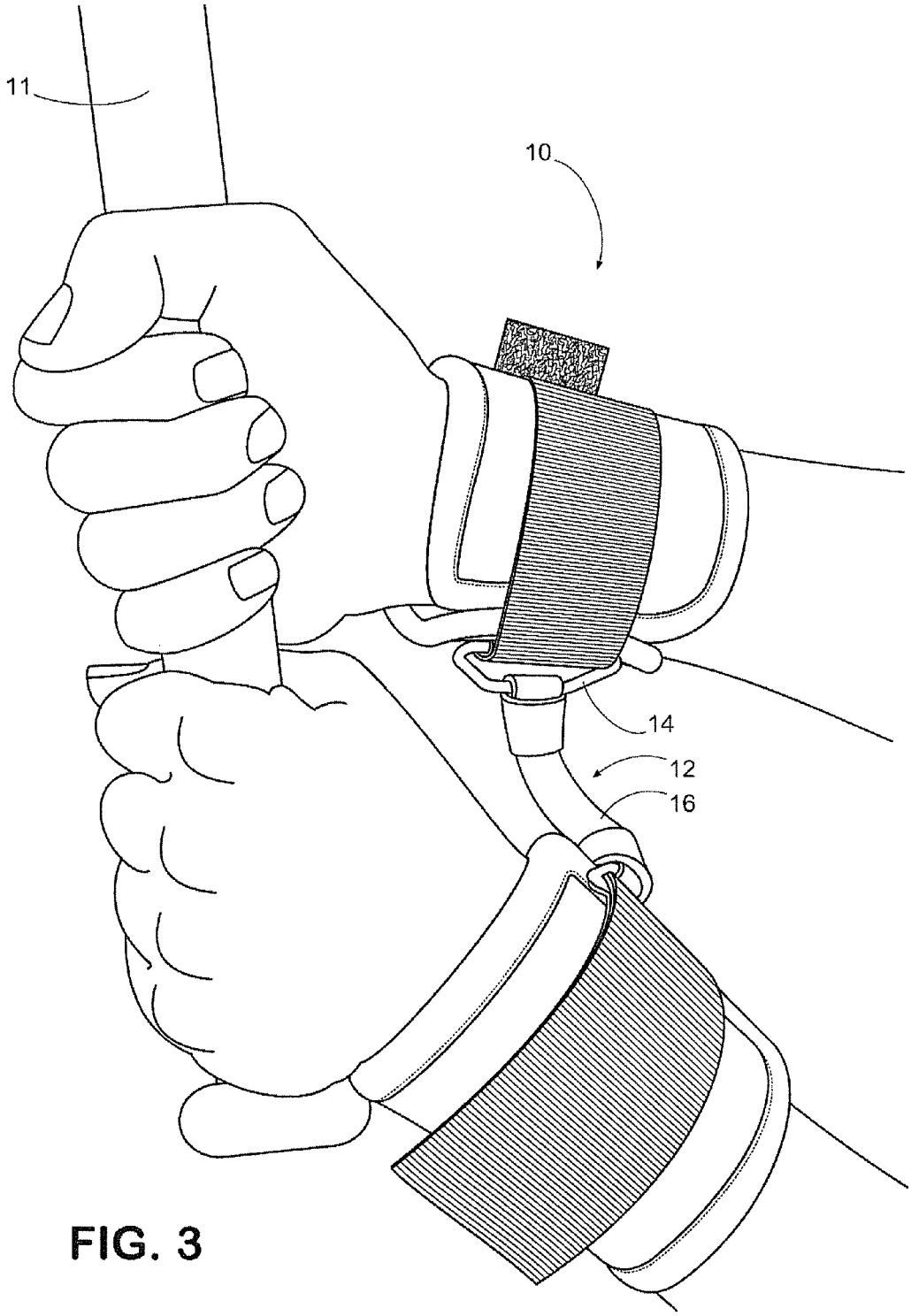
FIG. 3 is a magnified view of the disclosed device worn by a user with an exemplary object in the user's hands according to one embodiment of the present disclosure.

Referring now to the figures, FIG. 1 illustrates a perspective view of an exemplary embodiment of the athletic training device 10, which is designed to be worn by a person (also referred to as an "athlete", "player," or "wearer"). As shown in FIG. 1, the athletic training device 10 comprises a pair of cuffs 20 for encircling the wrists of a wearer, and a central connecting sub-assembly 12 for connecting the cuffs together. In one embodiment, the central connecting sub-assembly 12 comprises a pair of ring elements 14 and a connecting element 16 (e.g., emulsion hose, rubber connector, plastic tube, etc.). Alternate views of the athletic training device 10 are shown in FIGS. 2 and 3. In one embodiment, a strap 22 is attached to a cuff 20 enabling the cuff 20 to be wrapped around the wrists of an athlete. According to one embodiment, one end of the strap 22 enters through the orifice of the ring element 14, and loops around the wrists of a wearer while in use.

Figure 4:
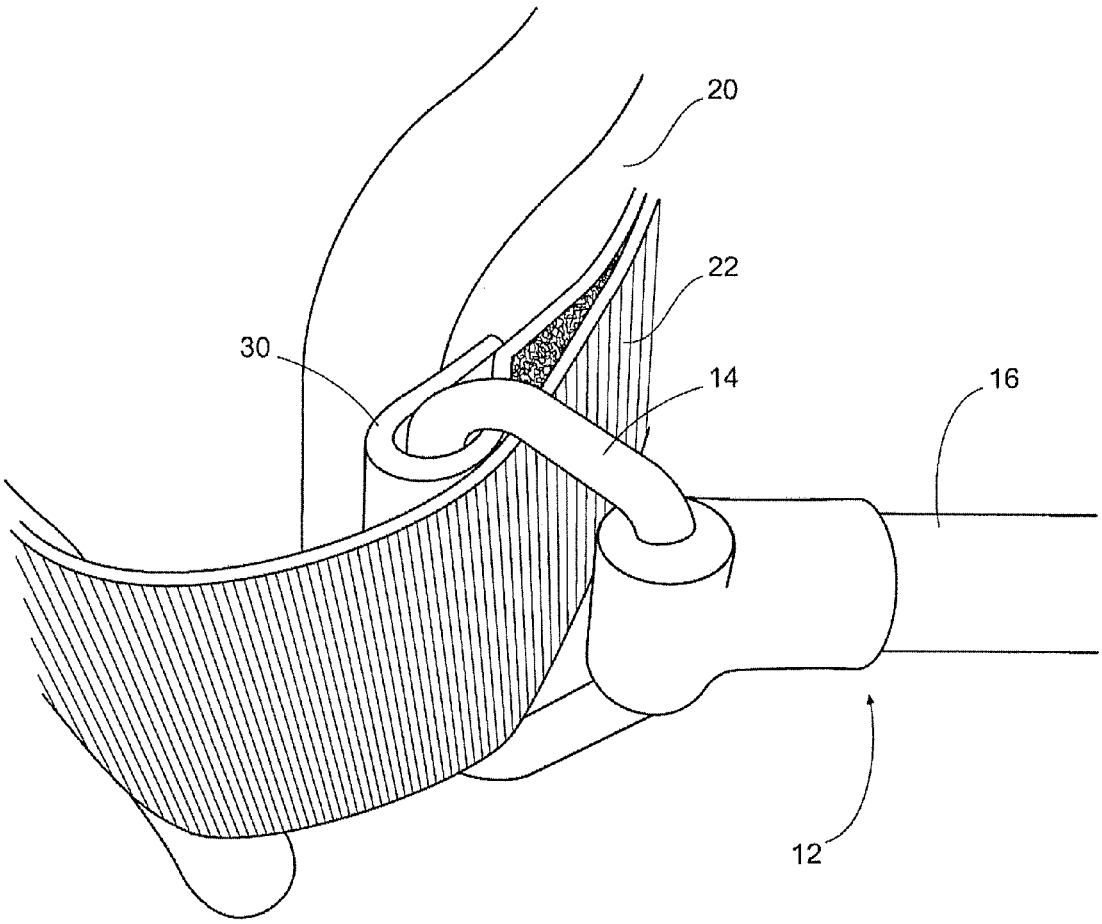
FIG. 4 is a magnified perspective view of one embodiment of the device, specifically of one end of a central connecting member of said device.

Additionally, the strap 22 typically comprises a fastening means (e.g., a snap system or a buckling system) ensuring the strap 22 can remain secure around the wrists of an athlete utilizing the cuff-based training device. As shown in FIG. 1 and according to one embodiment, the fastening system comprises a typical hook and loop-fastening system, whereby a loop portion 26 is attached to the exterior of the strap 22, and a hook portion 24 is located on the interior portion of the strap 22. For example, in FIGS. 2 and 3 a wearer 13 utilizing a cuff-based training device 10 is holding an exemplary object 11 used in swing sports such as a baseball, softball, or tennis. In FIG. 2, the exemplary object is a baseball bat held in a desired initial position with the wearer's hands positioned close together and close to the torso. A detailed enlarged picture of the strap 22, border trim 18, and connecting sub-assembly 12 comprising a ring element 14 and connecting element 16 is shown in FIG. 4. Further details concerning additional exemplary embodiments of the athletic training device 10 will be described in connection with FIGS. 5-8.

FIG. 2 illustrates an embodiment of the present device 10 in use by an athlete 13 holding an exemplary object 11. As shown, the device 10 ensures the wrists are in proper position, close together, and close to the torso via the central sub-connecting assembly 12 and in particular the connecting element 16. In various embodiments, the connecting element 16 is a resilient emulsion hose, rubber tube, resilient elastic band, etc. As will be generally discussed herein, the connecting element 16 is typically designed to provide a certain amount of elasticity, but enough rigidity to maintain correct form. Also shown in FIG. 2 are the cuffs 20 securely wrapped around tightened around the wearer's wrists. The adequate width of the hitting cuff 20 (discussed in more detail below), provides the necessary comfort (but also stability) required when the device 10 is utilized for extended periods of time.

Referring to FIGS. 3 and 4, additional details of the cuff-based athletic training device 10 are shown. For example, it is shown that the central connecting sub-assembly 12 comprises a connecting element 16 that attaches to ring elements 14. In the disclosed embodiment of the device 10, the connecting element 16 is cylindrically- or tubular-shaped and made of latex, elastic, or other elastomeric material. According to aspects of the present disclosure, such mechanical arrangements of the central connecting sub-assembly (discussed in the embodiments herein) enable restricted range of motion while being easily wearable and removable. In other embodiments, the central connecting sub-assembly 12 comprises only a latex tube, or equivalently, a unitary structure with terminating clips.

FIG. 4 illustrates a magnified view of one end of the central connecting sub-assembly 12. In one embodiment, the connecting element 16 is secured around the trapezoidal ring element 14 such that excess space along the shorter, vertical segment is minimal. Therefore, the width of the connecting element 16 and the designed height of the ring element 14 ensure there is minimal vertical movement of the connecting element 16 along the ring element 14. Similarly, the longer, vertical segment of the trapezoidal ring element 14 is constructed such that the width of the strap 22 fits around the ring element 14 with a minimal vertical clearance. This ensures the desired athletic position is maintained while executing athletic movements. In one embodiment, the eye 30 that contains the longer section of the trapezoidal ring element 14 is constructed by wrapping an excessive portion of the strap 22 around the ring element 14 and attaching the excess to the strap 22. In another embodiment, the eye 30 may wrap around the ring element 14 and affix to the interior of the cuff 20. It will be understood and appreciated by one of ordinary skill in the art that the geometric and material aspects of the rings, connecting element, and other members of the athletic training device disclosed herein are for exemplary purposes only, and are not intended to limit the spirit or scope of the disclosure in any way.

FIG. 5 (including FIGS. 5A and 5B) illustrates an exterior view and an interior view, respectively, of a combined cuff/strap assembly 50, which is used in the training device 10. The cuff/strap assembly 50 generally comprises a strap portion 22, a cuff 20 bordered by a fabric trim 18, and a fastening means 24, 26 for securing the hitting cuff 20 around a user's wrists. As previously mentioned, the cuff-based device 10 is utilized by athletes performing various movements. This device 10 generally comprises of cuff/strap assemblies 50 for encircling a user's wrists, which are simultaneously bound together to restrict movement between each wrist. Individual details of an exemplary cuff 20 and a strap 22 will further be discussed in connection with FIG. 6. Alternate embodiments of the cuff/strap assembly 50 include a size adjustment mechanism is attached to the strap 22 so that wearers with larger wrist sizes are able to utilize the athletic training device 10.

FIG. 5A illustrates a plan view of an exterior surface of the exemplary cuff/strap assembly 50. The strap portion 22 is generally affixed horizontally at or near the center of the cuff portion 20 via stitching, epoxy, high-strength adhesive, or some other similar attachment means. Additionally, a hook portion 24 of a typical hook and loop fastener such as VELCRO™, is located on the top of the strap 22 as shown in FIG. 5A. In one embodiment, adjacent to the hook portion 24 is an affixed logo or branding section 23 attached by a stitching means. Generally, one end of the strap 22 encompasses a perforation with a ring element 14 in its interior and the opposite end of the strap 22 is free of attachments. Although a typical hook and loop fastener 24, 26 is shown in FIG. 5, it will be understood by one of ordinary skill in the art that any fastening means can be utilized, such as snaps, metal buckles, plastic buckles, etc. Additionally, embodiments of the present device 10 are not limited to stitching, but may utilize high-strength adhesive, epoxy, or any other means of to construct the device.

Referring to FIG. 5B, a plan view of an interior surface of the cuff/strap assembly 50 is shown. In the embodiment shown, the loop portion 26 of the hook and loop fastener system is affixed to the underside of the strap 22, which enables the strap 22 when inserted through the ring element 14 and joined to the top side hook portion 24 to securely fix the cuff 20 around an athlete's wrists. Generally, the loop portion 22 is attached to the underside of the strap via a means of stitching. In one embodiment of the present device 50, the longitudinal length of the hook portion 24 and the longitudinal length of the loop portion 26 are configured to allow the user adjust the locations and lengths of the mating portions between the fasteners 24,26, thereby, enabling a device to be usable by athletes with wrists varying in size.

As discussed, another exemplary embodiment of the device 50 comprises a ring element 14 that enables the strap portion 22 to pass there through, thereby encircling the cuff portion 20 around the athlete's wrist. In one embodiment, ring element 14 is generally, but not necessarily trapezoidal shaped, tapering down to a shorter connecting end, and thus optimizing the connection. In another embodiment, the ring element 14 could be round or semi-circular, with a straight segment affixed to on one end of the strap 22. The round section could contain a smaller contoured segment (e.g., a latch or cut-out) that minutely, but adequately protrudes from the main round portion. The connecting element 16 would generally settle in this protruding section in a way that neutralizes the movement of the connecting element 16. Neutralization of the connecting element 16 ensures the connecting element 16 maintains a consistent and non-negotiating position on the ring element 14. The connection configurations of the connecting element 16 and the ring element 14 ensure consistent distance between hands and consistent distance between the hands and torso when performing desired exercises. The ring element 14 is typically made from a rigid material, such as metal, high-strength plastic, carbon-like material, or any other similar solid material and is attached to the strap 22 via an aperture located at one end of the strap 22.

Now referring to FIG. 6, a plan view and side view is shown of the hitting cuff 20, including the fabric border trim 18. In one embodiment of device 10, the cuff 20 is generally composed of a soft, comfortable, malleable material, such as polyester, neoprene, etc. ensuring comfortable (yet durable) use for athletes. The selection of the material generally provides a non-toxic and comfortable surface. Therefore, the hitting cuff 20 is able to promote the health of the athlete's skin. In one embodiment, a cuff 20 has padding (e.g., foam, rubber, cotton, etc.) in the middle of the material that comprises the cuff 20. In FIG. 6A, the cuff 20 is generally rectangular shaped, featuring contoured corners, and a relatively longer length than height. As will be understood and appreciated by one of ordinary skill in the art, embodiments of the present device are not limited to rectangular shaped cuffs 20, but utilize a cuff embodying any shape, such as square, trapezoidal, triangular, etc. In one embodiment, the length of the hitting cuff 20 hcl is generally in the range of 17-23 centimeters, preferably closer to 19.5 centimeters.

Also shown in FIG. 6A is the border trim 18, which is generally overlaid and attached around the perimeter of the cuff portion 20. In one embodiment, the trim 18 encompasses a border of approximately 1.3 centimeters. Generally, the height hch of the cuff 20, as stated previously, is relatively shorter than the length hcl and is in the range of 7.5-10.5 centimeters, ideally around 9 centimeters. In the embodiment represented in FIG. 6, the cuff 20 is relatively flat providing a light-weight article worn by an athlete.

FIG. 6B illustrates a side view of one embodiment of the cuff 20, illustrating the relative width. Generally, the width of the cuff is in the range of 2-5 millimeters thick, ideally around 3 millimeters. As will be understood and appreciated by one of ordinary skill in the art, embodiments of the present device are not limited to a relatively flat cuff 20, but further embodiments may comprise a cuff that is relatively thicker providing more of cushion between the strap 22 and an athlete. As will be further understood and appreciated by one of ordinary skill in the art, the relatively flat cuff 20 reduces the weight felt by the user and allows the wrists to bend and flex with ease.

In several cuff embodiments, a border trim 18 is attached (or stitched) around the cuff 20. The border trim 18 generally comprises a soft, elastic material such as polyester, nylon, etc., providing an extra layer of comfort and usability for the athlete. The border trim 18 requires enough height di to fold over the edge of the cuff portion 20, usually around 2.5 centimeters. Accordingly, once the border trim 18 is draped over the edge with an equal amount of material on the front and back of the cuff portion 20, it is affixed to the outer perimeter of the cuff 20 via some attaching means (stitching, high-strength adhesive, etc.) and contours in a curved nature around the edges. The overlapping border trim 18 combined with the cuff portion characterizes one embodiment of the cuff 20 of the device 10 presented in this disclosure.

FIG. 7 illustrates an exemplary embodiment of the strap portion 22, represented by FIGS. 7A, 7B, and 7C. Also shown in FIG. 7D is a detail of the ring element 14 that, in one embodiment, is connected to the robust strap 22. In one embodiment, the strap portion 22 is comprises a resilient and durable material (e.g. nylon, polypropylene, etc.). This durable material ensures that the strap 22 has the capability to withstand frequent and prolonged use by athletes. The strap 22 is generally rectangular shaped, with a longer length than height and attaches across the cuff 20 at or near the horizontal center. As shown in FIG. 7A, on one lateral end of the strap 22, a ring element 14 is affixed to a perforated portion of the strap 22. A product identification patch 23 is typically stitched to one end (e.g., either on or close to the hitting cuff 20) of the strap 22 identifying information such as the manufacturer, size, etc. As previously mentioned, the strap portion 22 is generally longer than wide. This particular embodiment enables the circumference of the strap 22 to sufficiently encircle a user's wrist and maintain usability with the presented device 10. The length of said strap 22 sl is generally, but not necessarily 30-35 centimeters, with a typical width of approximately 3-5 centimeters.

In another aspect, fasteners 24 and 26 (such as the hook and loop or "VELCRO™" fasteners) are stitched on the opposite end of the strap 22. The hook portion 24 is stitched to the top of the strap 22 and generally, comprises a relative length hl of 8-11 centimeters. A small clearance of about 1-3 centimeters is kept between the end of the strap 22 and the section of the hook 24 fasteners. A side view of the strap 22 (shown in FIG. 7B) reveals the loop orifice 30 through which the ring 14 passes therethrough; affixing the ring to the strap 22. In this particular example, which is not representative of all examples of the present embodiment, a surplus of the strap material, approximately 4 centimeters is folded underneath the strap to create the perforation for the ring 14. The surplus is stitched to the underside of the strap 22 to maintain the perforation 30 securely.

An interior view of the strap 22 is shown exemplarily in FIG. 7C. This view reveals one end of the strap (i.e., the side opposite the hook fastener 24 and on the opposing surface) comprising the loop fastener 26. Thus, in one embodiment, hooks 24 and loops 26 are paired together in a hook top—loop bottom (or inversely, hook bottom—loop top) combination such that the hooks fasten to the loops. In one embodiment, the loop portion 26 is approximately 12-16 centimeters long ll and securely affixes to the strap via (but not necessarily) a stitching process.

Additionally, a plan view of a ring element 14 is shown in FIG. 7D. As illustrated, the ring element 14 generally comprises a trapezoidal shape having two opposing sides, one shorter in length than the other, positioned in parallel, and the two other sides of equal length connecting the two parallel sections in a diagonal approach. While the longer of the parallel sides is securely affixed in the aforementioned opening 30 residing on the strap 22, the shorter parallel section houses the securely appended connecting element 16. In one embodiment, the outer diameter rol of the rings is approximately 2-2.7 centimeters and the inner diameter ril is generally 1-1.5 centimeters. The outer diameter rih of the rings is 3.7-4.5 centimeters and the inner diameter roh is 2.0 centimeters. Accordingly, in one embodiment shown the trapezoidal shape of the ring element 14 allows the connecting element 16 to stay in a fixed position upon the shorter parallel section of the ring element 14. Movement of the connecting element 16 about the ring element 14 is thereby negated; hence, as athletes utilize the disclosed device 10, optimum distance between the wrists and hands will be sustained ensuring proper athletic motions are executed.

Now referring to FIG. 8 (consisting of FIGS. 8A and 8B), exemplary details of connecting element 16 (e.g., emulsion hose) for an athletic training device 10 embodiment are shown. For example, as shown in FIG. 8A, in one embodiment, the connecting element 16 comprises durable, resilient, elastic tubing. In this particular example, the connecting element 16 is comprised of latex, but should not be limited to such construction, as other embodiments may comprise rubber, polyurethane, synthetic-rubber, or like materials. As illustrated in FIG. 8A, the connecting element 16 comprises a single tube with 0.5 centimeter inner-diameter, 0.2 centimeter wall thickness, and a 14 centimeter length. Also, as previously discussed, the connecting element 16 may further comprise two (2) elastic tubes, each tube engaging with a pair of terminating clips and connected to the rings 14 in various configurations. For example, one embodiment would include both clips looping under one ring and both clips terminating on the opposing ring (not shown). Yet another configuration would embody one connecting element 16 engaging terminating clips on either end and attaching to the rings in a cross-wise fashion. In one embodiment, when the device 10 is in use by an athlete the preferred distance between the cuffs 20 is generally between 3-5 centimeters, therefore the connecting element 16 would maintain a length ehl of approximately 3-5 centimeters.

TABLE 1

The resistance and strength data of the connecting element

| Max Strength Elongation | Max Stretch Iterations | Pulling Strength kg (lb) at 100% Elongation | Pulling Strength kg (lb) at 200% Elongation | Pulling Strength kg (lb) at 300% Elongation |
|---|---|---|---|---|
| 500% | 9260 | 5.24 (11.56) | 7.04 (15.51) | 7.93 (17.48) |

Table 1 provides data relating generally to properties of one embodiment of the connecting element 16. The data presented in Table 1 represent approximations and are not necessarily intended to limit the description or scope presented within, but merely facilitates description of several embodiments within the present disclosure. According to one embodiment of the connecting element 16, when utilized, the connecting element 16 is designed for an approximate maximum strength elongation of 500%. For example, as an athlete executes various motions, the furthest extent to which the connecting medium will stretch is 500% of its equilibrium length. Additionally, and as shown in Table 1, the relative multitude of repetitious elongations that may be performed on the emulsion tube is 9260 occurrences. Furthermore and still referring to Table 1, the relative pulling strength at 100%, 200%, and 300% elongation is 5.24 kgs. £11.56 lbs.), 7.04 kgs. (15.51 lbs.), and 7.93 kgs. (17.48 lbs.), respectively. The aforementioned exemplary embodiments exhibit the present device's ability to allow repetitive athletic movements, and adequate flexibility, while maintain appropriate resistance and rigidity.

Now turning to FIG. 8B, exemplary details of a connecting element 16 in combination with a hitting cuff/strap assembly is shown 50. According to one aspect, a hitting cuff 20 is attached to a strap 22 further comprising a hook fastener 24 and a ring element 14 secured within the perforation 30 of said strap 22. As shown in FIG. 8B, two identical hitting cuff/strap assemblies 50 are centrally coupled per the ring elements 14 engaging the connecting element 16. As will be understood and appreciated, the connecting element 16 can be attached to the ring elements 16 in a variety of ways. For example, at either end of the connecting element 16 approximately 5.0 centimeters towards the center is a horizontal incision exposing the center cavity of the connecting element 16. As a means of securing the emulsion tube to the ring 14, one end of the connecting element 16 is pulled underneath a respective ring 14 so the aforementioned incision resides adjacent and parallel to the shorter section of the ring. This ensures one of the sides of the connecting element 16 extending from the under the ring is considerably longer than the other. The considerably longer side of the connecting element 14 is subsequently wrapped around the ring with both the longer and shorter sides of the connecting element adjacent and parallel. The hollow central cavity in the shorter side of the connecting element is exposed by opening said incision and pulling the considerably longer end of the connecting element 16 through. It will be understood and appreciated by one of ordinary skill in the art, there is a plurality of means available concerning securing the connecting element 16 to the ring elements 14, hence the demonstrated method is not intended as a comprehensive means. In other embodiments, the connecting element 16 may be attached to the ring elements 14 via ties, spot welds, high-strength adhesives, clips, etc. Further, in one embodiment, the connecting element 16 is integrally affixed to the straps 22 via stitching or some other attachment means.

The foregoing description of the exemplary embodiments has been presented only for the purposes of illustration and description and is not intended to be exhaustive or to limit aspects of the present disclosure to the precise forms disclosed. For example, according to other embodiments, the connecting element 16 (or, generally the central connecting sub-assembly 12 of the athletic training device 10) may include breakaway bands. Alternately, embodiments of the present athletic training device can include other mechanisms of fastening the hitting cuffs to the wearer's hands, instead of a traditional hook-loop combination. In yet other embodiments, the athletic training device comprises sub-components that can be detachable, e.g., a hitting cuff, strap, a central connecting sub-assembly, and others, such that the overall athletic training device can be assembled and disassembled easily. As will be further understood, embodiments of the present athletic training device may comprise sub-components that are manufactured from a variety of materials, including rubber, acrylics, nylon, steel, metal, plastics, and any other material that is customarily used in sports articles manufacturing. Further, embodiments of the present athletic training device may comprise various sizes to accommodate different-sized wearers. Many modifications and variations are possible in light of the above teaching.

The embodiments were chosen and described in order to explain the principles of the inventions and their practical application so as to enable others skilled in the art to utilize the inventions and various embodiments and with various modifications as are suited to the particular use contemplated. Alternative embodiments will become apparent to those skilled in the art to which the present inventions pertain without departing from their spirit and scope. Accordingly, the scope of the present inventions is defined by the appended claims rather than the foregoing description and the exemplary embodiments described therein.

What is claimed is:

1. A training device for use by an athlete for improving the athlete's swing in connection with swing-based sports, whereby the training device is worn on the wrists of the athlete, comprising:

a pair of flexible cuffs configured to be worn around the wrists of the athlete when the training device is in use, wherein each of the flexible cuffs comprises a padded inner cuff member for contacting and encircling a wrist of the athlete and an outer strap affixed along an outer circumferential surface of the padded inner cuff member for tightening the padded inner cuff member around the wrist of the athlete;

a pair of trapezoidal connector elements, wherein each trapezoidal connector element is affixed to a respective outer strap of a respective flexible cuff, wherein a longer parallel length of each trapezoidal connector element is operatively connected to each respective flexible cuff through an eye loop of the outer strap; and a connecting hose element affixed to the pair of trapezoidal connector elements for connecting the pair of flexible cuffs to each other, the connecting hose element being securely wrapped around a smaller parallel length of each trapezoidal connecting element to prevent slippage of the connecting hose element, wherein the connecting hose element comprises a latex hose having the dimensions of:

an inner diameter of about 5-8 mm, a wall thickness of about 2-2.5 mm, and a length of about 3-5 cm, wherein the length comprises the length between the pair of trapezoidal connector elements operatively connected to the pair of flexible cuffs.

2. The training device of claim 1, wherein the connecting hose element comprises a property selected from the group consisting of a pulling strength of about 5.24 kg at 100% elongation, a pulling strength of about 7.04 kg at 200% elongation, and a pulling strength of about 7.93 kg at 300% elongation.

3. The training device of claim 1, wherein the connecting hose element comprises a maximum stretch elongation of about 500% of an original length of the connecting hose element.

4. The training device of claim 1, wherein the outer strap of each of the flexible cuffs is adjustable for adjusting the diameter of the padded inner cuff member to accommodate varying wrist sizes of the athlete.

5. The training device of claim 1, wherein the connecting hose element comprises a maximum of number of stretches of about 9260 iterations.

* * * * *